US005284250A

United States Patent [19]

Stepenhoff

[11] Patent Number: 5,284,250

[45] Date of Patent: Feb. 8, 1994

[54] PARTICLE SEPARATION APPARATUS

[76] Inventor: Gary F. Stepenhoff, 8732 E. Piccadilly, Scottsdale, Ariz. 85251

[21] Appl. No.: 759,213

[22] Filed: Sep. 13, 1991

[51] Int. Cl.[5] ..... B03B 5/00

[52] U.S. Cl. ..... 209/211; 210/512.1

[58] Field of Search ..... 209/208, 210, 211; 210/787, 512.1, 374

[56] References Cited

U.S. PATENT DOCUMENTS

| | | | |
|---|---|---|---|
| 3,235,091 | 2/1966 | Doll et al. | 209/210 X |
| 4,120,783 | 10/1978 | Baummer | 209/210 |
| 4,759,854 | 7/1988 | Wilson | 209/211 X |
| 4,863,605 | 9/1989 | Rienecker | 209/211 X |
| 5,104,520 | 4/1992 | Maronde et al. | 209/211 X |
| 5,114,568 | 5/1992 | Brinsmead et al. | 209/211 X |

FOREIGN PATENT DOCUMENTS

| | | | |
|---|---|---|---|
| 30003 | 7/1954 | Switzerland | 209/211 |

*Primary Examiner*—Donald T. Hajec
*Attorney, Agent, or Firm*—Tod R. Nissle

[57] ABSTRACT

Apparatus which separates particles by size or by specific gravity. The apparatus separates particles from a liquid slurry by directing the slurry into a particle separation chamber which circulates slurry particles along helical paths in the chamber. The apparatus continues to circulate slurry particles along helical paths of travel after the flow of liquid slurry into the particle separation chamber is discontinued.

6 Claims, 2 Drawing Sheets

PARTICLE SEPARATION APPARATUS

BACKGROUND OF THE INVENTION

1. Field of the Invention

This invention relates to particle separation apparatus which separates particles by size or by specific gravity.

More particularly, the invention relates to apparatus which separates particles from a liquid slurry by directing the slurry into a particle separation chamber which circulates slurry particles along helical paths in the chamber.

In a further respect, the invention relates to particle separation apparatus of the type described which continues to circulate slurry particles along helical paths of travel after the flow of liquid slurry into the particle separation chamber is discontinued.

In another respect the invention relates to particle separation apparatus of the type described which can readily and efficiently separate from a liquid slurry a particle size fraction which is comprised entirely either of particles less than 150 mesh in size or of particles greater than 3 mesh in size.

In still a further respect, the invention pertains to particle separation apparatus of the type described which does not require a large difference between the inlet pressure and outlet pressure, and which does not require that liquid slurry be directed into the particle separation chamber under pressure in order for the apparatus to operate efficiently.

2. Description of the Related Art

Hydrocyclones are commonly utilized to separate particles from a liquid slurry. The particles are separated by size or by specific gravity. In a hydrocyclone, a slurry is pumped under pressure through an orifice into a conically shaped housing. The conically shaped housing causes the slurry to travel along an ever decreasing helical path. Heavier (or larger) particles segregate along the conical wall of the housing while lighter (or smaller) particles segregate inwardly from the housing wall. Several disadvantages are associated with conventional hydrocyclones. First, if there is an interruption in the flow of pressurized slurry through the orifice into the hydrocyclone, the internal flow of slurry through the hydrocyclone collapses. Second, hydrocyclones are, practically speaking, limited to performing particle separation on slurries which contain particles no larger than about one quarter of an inch. Third, a particular limitation of hydrocyclones is that hydrocyclones can only achieve relatively rough splits when removing particle size fractions from a slurry. Fourth, hydrocyclones do not permit liquid or gas overflow which is at the center of hydrocyclone to be both forced out under pressure generated in the hydrocyclone and suctioned out of the hydrocyclone under vacuum.

Accordingly, it would be highly desirable to provide an improved particle separation apparatus which maintained its internal energy during the ebb and flow of the liquid slurry stream feeding the apparatus, which could readily process slurries containing large or small particles, which could both pump particles out under internal hydrocyclone pressure and draw particles out of the hydrocyclone under vacuum, and which could accurately achieve a greater number of particle splits than conventional hydrocyclones, such splits being made according to particle size or particle specific gravity.

Therefore, it is a principal object of the invention to provide an improved particle separation apparatus.

A further object of the invention is to provide improved apparatus which separates particle size fractions or particle specific gravity fractions from a liquid slurry by directing the slurry into a particle separation chamber which circulates the slurry along uninterrupted continuous helical paths of travel in the separation chamber.

Another object of the invention is to provide improved particle separation apparatus of the type described which maintains the flow of slurry particles along continuous helical paths of travel in the separation chamber even after the input of slurry into the chamber has been discontinued or interrupted.

Still a further object of the invention is to provide improved particle separation apparatus of type described which enables liquid slurry to be input into the particle separation chamber moving only under the force of gravity at atmospheric pressure.

Yet another object of the invention is to provide improved particle separation apparatus of the type described which efficiently produces particle size fractions comprised either of small or large particles.

BRIEF DESCRIPTION OF THE DRAWINGS

These and other further and more specific objects and advantages of the invention will be apparent to those skilled in the art from the following detailed description thereof, taken in conjunction with the drawings in which.

SUMMARY OF THE INVENTION

Figure 1:
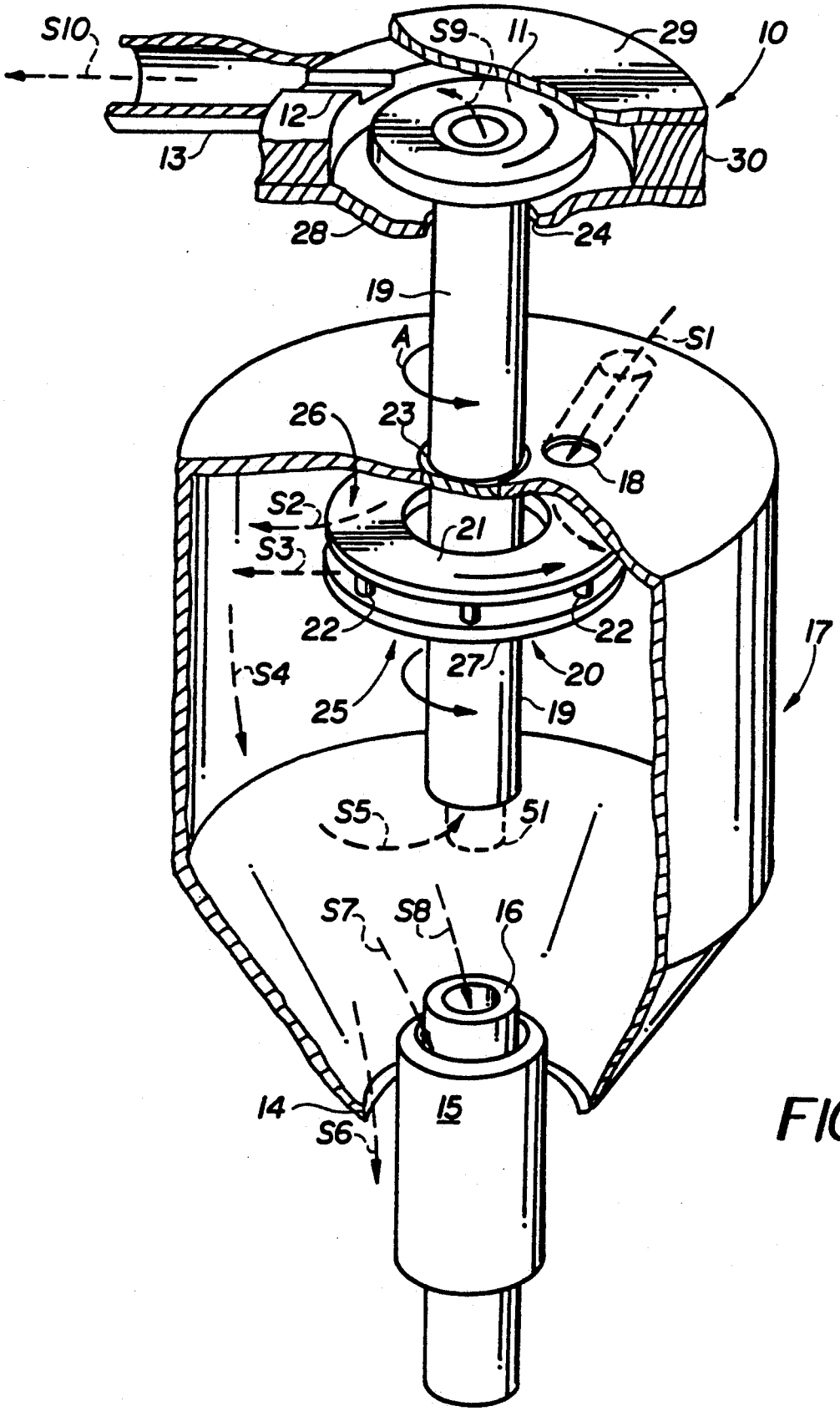
FIG. 1 is a break away perspective view of particle separation apparatus constructed in accordance with the invention; and, FIG. 2 is a side section view of the apparatus of FIG. 1 further illustrating construction details thereof.

Briefly, in accordance with my invention, I provide improved apparatus for separating from a liquid slurry fractions of particles contained in the slurry. The apparatus includes wall means defining a separation chamber; an orifice formed in the chamber; a rotary distributor in the chamber provided with rotating distribution disk means, the disk means having an upper surface and a lower surface; means for rotatably driving the disk means; outlet means formed in said wall means; an open toroidal-shaped particle circulation space intermediate the disk means and the outlet means and circumscribed by a portion of the wall means, the outlet means opening directly into the toroidal-shaped space; and, means for charging a selected quantity of liquid slurry material through the orifice into the separation chamber in a direction toward the upper surface of the disk means to impinge the upper surface for outward radial distribution by the disk means. The disk means provides the motive power to move the slurry material outwardly in the chamber away from the disk means, a first portion of the slurry material in a primary continuous helical path of travel away from the disk means and the orifice through the toroidal-shaped space toward and into the outlet means; and a second portion of the slurry material in a secondary recirculating helical path of travel. The recirculating helical path of travel moves slurry material away from the disk means and the orifice through the toroidal-shaped space toward the outlet means, and then moves the slurry material away from the outlet means back toward and proximate the lower surface of the disk means. The lower surface of the disk means imparts energy to the secondary portion of the slurry material to move the secondary portion along the secondary recirculating helical path of travel. A quantity of the second portion of the slurry material continues to move along the secondary recirculating helical path of travel after the selected quantity of liquid slurry is charged into the separation chamber and the charging of slurry material into the chamber id discontinued.

In another embodiment of my invention, I provide apparatus for separating from a liquid slurry fractions of particles in the liquid slurry. The apparatus includes wall means defining a separation chamber; a rotary distributor in the chamber provided with rotating distributor disk means, the disk means having an upper surface and a lower surface; means for rotatably driving the disk means; first outlet means for a greater particle fraction and including at least a first hollow tube; an open toroidal-shaped particle circulation space intermediate the disk means and the outlet means and circumscribed by a portion of the wall means, the space having a central area; second outlet means for a lesser particle fraction and including a second hollow tube having a first end extending from the disk means into the central area of the toroidal-shaped space and a second end extending outwardly from the disk means and away from the toroidal-shaped space; means for charging liquid slurry material into the separation chamber in a direction toward the upper surface of the disk means to impinge the upper surface for outward radial distribution by the disk means, the disk means providing the motive power to move said material outwardly in the chamber away from the disk means, and in helical paths of travel away from the disk means and the orifice through the toroidal-shaped space toward the first and second outlet means; and, means for applying a vacuum to the second end of the second tube to draw the lesser particle fraction in the slurry material through the first end and out the second end of the second hollow tube.

In still another embodiment of my invention, I provide apparatus for separating from a liquid slurry fractions of particles in the liquid slurry. The apparatus includes wall means defining a separation chamber; an orifice formed in the chamber and having a selected cross-sectional area; a rotary distributor in the chamber provided with rotating distribution disk means, the disk means having an upper surface and a lower surface; means for rotatably driving the disk means; outlet means including at least a first tube within and spaced apart from a second tube, the first and second tubes defining a cross-sectional area through which particles in the liquid slurry pass, the cross-sectional area of the orifice being greater than the cross-sectional area of the outlet means; an open toroidal-shaped particle circulation space intermediate the disk means and the outlet means and circumscribed by a portion of the wall means, the outlet means opening directly into the toroidal-shaped space; and, means for charging a selected quantity of liquid slurry material through the orifice into the separation chamber in a direction toward the upper surface of the disk means to impinge the upper surface for outward radial distribution by the disk means. The disk means provides the motive power to move the slurry material outwardly in the chamber away from the disk means; and, in helical paths of travel away from the disk means and the orifice through the toroidal-shaped space toward the outlet means.

DESCRIPTION OF THE PREFERRED EMBODIMENTS

Figure 2:
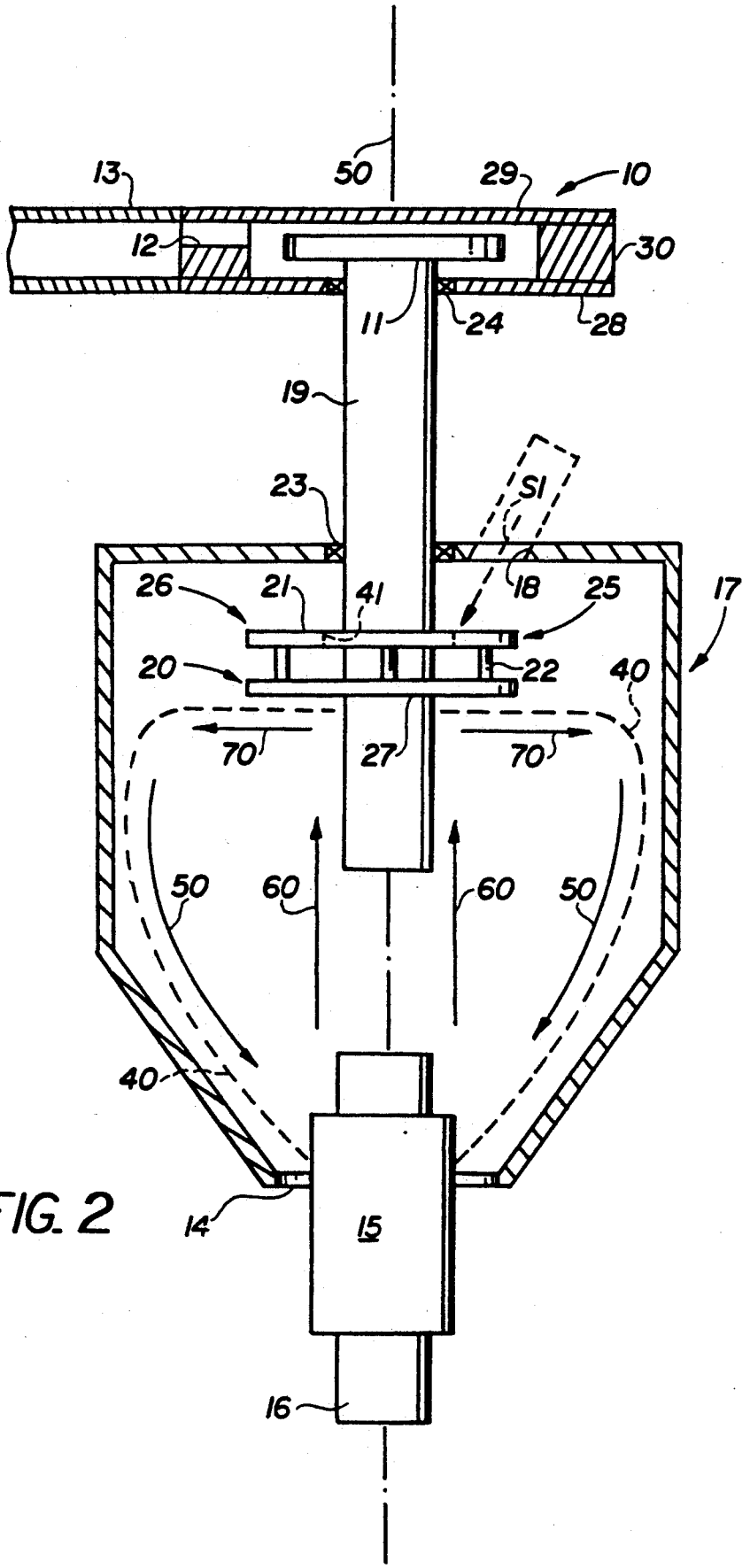

Turning now to the drawings, which describe the presently preferred embodiments of the invention for the purpose of illustrating the practice thereof and not by way of limitation of the scope of the invention, and in which like characters identify corresponding elements throughout the several views, FIGS. 1 and 2 illustrate particle separation apparatus constructed in accordance with the principles of the invention and including wall means defining particle separation chamber 17, orifice 18 formed in chamber 17 for charging a selected quantity of liquid slurry material through orifice 18 in the direction indicated by arrow S1 into chamber 17 to impinge the upper surface 21 of disk means 25. Disk means 25 includes disk 20 and disk 26. Disk 20 includes lower circular surface 27 and is fixedly secured to hollow rotating shaft 19. Disk 26 is connected to disk 20 by a plurality of spaced apart pins 22. Shaft 19 passes through a concentric aperture 41 which is formed through disk 26. Shaft 19 does not contact disk 26. Disks 26 and 27 rotate simultaneously with hollow shaft 19 and with disk 11 connected to the upper end of shaft 19. Shaft 19 is journalled for rotation in bushing or seal unit 23. A driven belt or other means (not shown) are provided for rotating shaft 19 in the direction of arrow A in fixed chamber 17. When shaft 19 rotates disk 11 also simultaneously rotates in the direction of arrow A in hollow cylindrical housing 10. Housing 10 includes parallel opposed circular panel members 28 and 29 attached to ring 30. Rectangular passageway 12 is formed through ring 30. When disk 11 rotates in housing 10, disk 11 generates a vacuum in housing 10 which tends to draw material into the lower end of hollow tubing 19 in the direction of arrow S5. Material drawn into tubing 19 in the direction of arrow S5 exits the upper end of tubing 19 in the manner indicated by arrow S9, travels through slot 12, and travel through exhaust conduit 13 in the direction indicated by arrow S10.

Liquid slurry material which is directed through orifice 18 in the direction of arrow S1 impinges upper surface 21 of disk 26 and also impinges the upper surface of disk 20. Liquid slurry material which impinges the upper surfaces of disks 20 and 26 is outwardly radially distributed by rotating disks 20 and 26 in the manner indicated by arrows S2 and S3. Material outwardly distributed in the direction of arrows S2 and S3 ordinarily strikes the cylindrical wall of chamber 17 and moves downwardly along a helical path of travel in the direction of arrow S4. As the slurry material moves downwardly in the direction of arrow S4, the material follows a helical path which moves through open toroidal-shaped particle circulation space 40 and circumscribes the longitudinal axis 50 which defines the centerline of rotating tubing 19 and stationary tubing 16. Toroidal-shaped space 40 lies intermediate disk means 25 and the particle outlet means comprised of hollow concentric spaced apart tubes 14, 15, and 16. Space 40 is circumscribed by a portion of the cylindrical wall of chamber 17. In the practice of the invention it is important that at least the peripheral areas of space 40 be open and unobstructed so that slurry material distributed by disk means 25 has free primary helical paths of travel along which to move as the material descends downwardly from disk means 25 in an ever tightening spiral toward the particle outlet means comprised of tubes 14, 15 and 16. Similarly, the toroidal-shaped space 40 must permit slurry material to move along unobstructed primary helical paths of travel from disk means 25 in the direction of arrows S4 and S5 into the lower end of tubing 19.

If the input of slurry material into chamber 17 through orifice 18 is discontinued or interrupted, rotating disk means 25 provides motive power such that some of the slurry material continues to travel along secondary recirculation helical paths in chamber 17 and chamber 17 is not completely purged of slurry material. This is a particularly desirable feature of the invention because a disruption in the input flow of slurry material in the direction of arrow S1 does not cause the collapse of the internal energy and the flow of slurry material along helical paths in chamber 17. A secondary recirculation helical path is illustrated in FIG. 2 by arrows 50A; 60 and 70. Particles (liquid slurry) in the secondary helical path move downwardly in the direction of arrows 50A in a converging helical path which spirals around axis 50. Once the particles (liquid slurry) reach a position proximate tubes 15 and 16, the particles begin to move upwardly in the direction of arrows 60 in a helical path around axis 50. Once the particles reach a position proximate rotating disk 20, the surface 27 and/or the boundary layer on surface 27 imparts energy to the particles and causes them to move outwardly in the direction indicated by arrows 70. After the input of liquid slurry through orifice 18 is discontinued, a portion of the slurry continues to move along a secondary recirculation helical path like the path illustrated in FIG. 2, and the chamber 17 does not completely purge itself of liquid slurry.

In FIGS. 1 and 2, tubes 14, 15, and 16 extend directly into space 40, which facilitates the travel of slurry material from disk means 25 through space 40 directly into tubes 14, 15 and 16 in the manner indicated by arrows S6, S7 and S8, respectively. As used herein, the term "greater fraction" shall indicate a quantity or fraction of liquid slurry which contains a plurality of particles that are either of a greater size or greater specific gravity than a plurality of particles which are found in another quantity of liquid slurry which comprises a "lesser fraction". Consequently, a greater fraction of slurry will include particles which are of greater size or greater specific gravity than the particles found in a lesser fraction of slurry. A greater fraction of slurry will usually weigh more than a lesser fraction of slurry. The material flowing into tube 14 intermediate the walls of tubes 14, 15 is a greater fraction of the liquid slurry than the material flowing through tube 15 intermediate the wall of tube 15 and the wall of tube 16. The material flowing intermediate the walls of tubes 15 and 16 is a greater fraction of the liquid slurry than the material flowing through tube 16 in the direction of arrow S8. Ordinarily, the material flowing through tube 19 in the direction of arrow S5 is a lesser fraction of the slurry than is the material flowing through tube 16 in the direction of arrow S8. In fact, when the liquid slurry contains a gas, the gas can be removed through tube 19 along with little or no liquid or particulate.

In one embodiment of the invention, the cross-sectional area of orifice 18 is larger than the combined cross-sectional areas of tubes 14, 15 and 16 through which liquid and coarse particulate leaves chamber 17. When the cross-sectional area of orifice 18 is larger than the combined cross-sectional areas of tubes 14, 15 and 16, a back pressure is generated inside chamber 17 which tends to force or pump material out through tube 19 in the manner indicated by arrows S5 and S9.

The cross-sectional area of orifice 18 is circumscribed by the cylindrical wall of orifice 18. In other words, the cross-sectional area of orifice 18 defines an area through which slurry moves. Similarly, the cross-sectional area of tubes 14 to 16 designates the actual area through which slurry exits chamber 17. In FIG. 2, the cross-sectional area of tubes 14 to 16 equals the cross-sectional area of tube 14 minus the cross-sectional area of the walls of tubes 15 and 16.

As would be appreciated by those of skill in the art, one or more disks 11 can be utilized in housing 10, and one or more disks 26 can be utilized in chamber 17. It is preferred that the upper and lower surfaces or faces of disks 11, 25 and 26 be as planar, smooth and obstruction free as possible to facilitate the radial boundary layer centrifugal distribution of liquid slurry.

A particular advantage of the invention is that liquid slurry containing up to 50% by volume and 70% by weight solids can be fed into chamber 17. Further, the apparatus of FIGS. 1 and 2 can be readily constructed to accept slurries which include large particles in excess of ¼" in diameter.

Toroidal-shaped space 40 can be conically shaped, donut shaped, or any other desired shape which permits liquid slurry distributed by disk means 25 to follow an unobstructed helical path of travel as the slurry moves downwardly toward tubes 14, 15, and 16. Hollow tube 51 can be concentrically positioned in and spaced apart from tubing 19. The length of tube 51 is approximately equal to the length of tube 19 in FIG. 1. When tube 51 is inserted in tubing 19, tube 51 can be utilized to remove particulate which is finer than particulate passing intermediate the inner surface of tube 19 and tube 15.

The particle separation apparatus of FIGS. 1 and 2 and can be efficiently operated when the pressure of the slurry input through orifice 18 is approximately equal to the pressure under which portions of the slurry exits chamber 17 through tubes 14 to 16. For example, slurry fed into chamber 17 through orifice 18 can be under twenty pounds per square inch of pressure while the fractions of the slurry exiting chamber 17 through tubes 14 to 16 could, depending on the volume and density of solids in a given volume of slurry, be under about nineteen pounds of pressure. The difference between the slurry input pressure and output pressure often is less than five psi. This feature of the invention is desirable because it eliminates the significant pressure drop which occurs in conventional hydrocyclones between the inlet and the outlet of the hydrocyclone. The lack of a significant drop in pressure between the inlet and outlet of the particle separator of the invention, along with the internal drive energy provided by disk means 25, enables the separator to more readily be operated upside down or in any other desired orientation. The apparatus of FIGS. 1 and 2 assumes an upside down orientation when the apparatus is rotated 180 degrees about an axis perpendicular to the plane of the sheet of paper of the drawings. When the apparatus of FIGS. 1 and 2 is operated in an upside down orientation, disk means 25 displaces slurry material in chamber 17 along a primary helical path which moves slurry material from disk means 25 against the force of gravity and upwardly toward and into tubes 14 to 16.

Disks 20 and 26 can rotate at any desired RPM, provided that points on the circular circumferential edge of either disk do not exceed the speed of sound in the slurry. If points on the peripheral circumferential edge of either disk exceed the speed of sound in the slurry, a shock wave is produced which moves across the circular surface of the disks and tends to disrupt the boundary layers which are formed on the surfaces of the disks. The diameters and thickness of disks 20 and 26 can vary as desired. While is it presently preferred that the surfaces of disks 20 and 26 comprise smooth continuous planar surfaces, openings can, if desired, be formed in or through the disks or disks 20 and 26 can be variously shaped and dimensioned as long as disk means 25 performs the functions of outwardly radially distributing slurry along the primary and secondary helical paths of travel discussed above. One or more disks can be affixed to tubing 19.

Having described my invention in such terms as to enable those skilled in the art to understand and practice the invention,

I claim:

1. In apparatus for separating from a liquid slurry fractions of particles contained in the liquid slurry, (a) wall means defining a separation chamber;

(b) an slurry feed orifice formed in said chamber;

(c) a rotary distributor in said chamber provided with rotating distribution disk means, said disk means including at least first and second spaced apart disks each having a smooth planar upper surface free of vanes and a smooth planar lower surface free of vanes, said first disk including a central slurry distribution aperture formed therethrough;

(d) means for rotatably driving said disk means;

(e) outlet means, formed in said wall means;

(f) an open toroidal-shaped particle circulation space intermediate said disk means and said outlet means and circumscribed by a portion of said wall means, said outlet means opening directly into said toroidal-shaped space;

(g) means for charging a selected quantity of liquid slurry through said orifice into said separation chamber and against said disk means such that the liquid slurry (i) in part, impinges said upper surface of said first disk means, and (ii) in part, passes through said slurry distribution aperture and impinges said upper surface of said second disk for outward radial distribution by said upper planar surface of said first disk and said upper surface of said second disk, said disk means providing the motive power to move (i) the slurry outwardly over said upper planar surfaces of said disks and into said chamber away from said disk means, (ii) a first portion of the slurry outwardly over said upper planar surfaces of said disks and into said chamber in a primary continuous helical path of travel away from said disk means and said orifice through said toroidal-shaped space toward and into said outlet means, (iii) a second portion of the slurry in a secondary recirculating helical path of travel away from said disk means and said orifice through said toroidal-shaped space toward said outlet means, and away from said outlet means back toward and proximate said lower surface of said second disk, said smooth planar lower surface of said second disk imparting energy to said secondary portion of the slurry to move said secondary portion along said secondary recirculating helical path of travel, a quantity of said second portion of the slurry continuing to move along said secondary recirculating helical path of travel after said selected quantity of liquid slurry is charged into said separation chamber and the charging of the slurry into said chamber is discontinued.

2. The apparatus of claim 1 wherein said outlet means includes at least a first hollow tube and a second hollow tube, said first tube being within and spaced apart from said second tube, said first and second tubes opening directly into said toroidal-shaped space.

3. Apparatus for separating from a liquid slurry fractions of particles contained in the liquid slurry, including (a) wall means defining a separation chamber;

(b) a rotary distributor in said chamber provided with rotating distributor disk means, said disk means having an upper surface and a lower surface;

(c) means for rotatably driving said disk means;

(d) first outlet means for a greater particle fraction including at least a first hollow tube;

(e) an open toroidal-shaped particle circulation space intermediate said disk means and said first outlet means and circumscribed by a portion of said wall means, said space having a central area;

(f) second outlet means for a lesser particle fraction and including a second hollow tube having a first end extending from said disk means into said central area of said toroidal-shaped space and a second end extending (i) outwardly and spaced apart from said disk means, and (ii) away from said toroidal-shaped space;

(g) means for charging liquid slurry into said separation chamber in a direction toward said upper surface of said disk means to impinge said upper surface for outward radial distribution by said disk means, said disk means providing the motive power to move the liquid slurry (i) outwardly in said chamber away from said disk means, and (ii) in helical paths of travel away from said disk means and said orifice through said toroidal-shaped space toward said first and second outlet means; and, (h) means for applying a vacuum to said second end of said second tube when said second tube is filled with air to draw said lesser particle fraction in the slurry through said first end into second tube and out said second end of said second hollow tube.

4. The apparatus of claim 3 wherein said second tube is oriented such that said vacuum draws said lesser particle fraction into said second tube against the force of gravity.

5. The apparatus of claim 3 including (a) a disk (11) fixedly attached to said second end of said second tube (19);

(b) a housing (10) for said disk and said second end of said second tube (19); and, (c) means for rotating said second tube (19) and said disk (11) to generate a vacuum in said housing (10) which draws air out of said second tube and draws the slurry into said first end and through said second tube (19).

6. In apparatus for separating from a liquid slurry fractions of particles contained in the liquid slurry, (a) wall means defining a separation chamber;

(b) a slurry distribution orifice formed in said wall means of said chamber and having a selected cross-sectional area;

(c) a rotary distributor in said chamber provided with rotating distribution disk means, said disk means having an upper surface and a lower surface;

(d) means for rotatably driving said disk means;

(e) outlet means including a first tube and at least a second tube within and spaced apart from said first tube, said first and second tubes defining a cross-sectional area through which particles in the liquid slurry pass, the cross-sectional area of said orifice being greater than the cross-sectional area of said outlet means;

(f) an open toroidal-shaped particle circulation space intermediate said disk means and said outlet means and circumscribed by a portion of said wall means, said outlet means and said orifice opening directly into said toroidal-shaped space;

(g) means for charging a selected quantity of liquid slurry through said cross-sectional area of said orifice and directly into said separation chamber in a direction toward said upper surface of said disk means to impinge said upper surface for outward radial distribution by said disk means, said disk means providing the motive power to move the slurry (i) outwardly in said chamber away from said disk means, and (ii) in helical paths of travel away from said disk means and said orifice, through said toroidal-shaped space toward said outlet means, and through said cross-sectional area of said outlet means, and into said first and second tubes, the slurry exiting the separation chamber only through said outlet means.

* * * * *

UNITED STATES PATENT AND TRADEMARK OFFICE

CERTIFICATE OF CORRECTION

PATENT NO. : 5,284,250
DATED : February 8, 1994
INVENTOR(S) : Gary F. Stepenoff

It is certified that error appears in the above-indentified patent and that said Letters Patent is hereby corrected as shown below:

Title page, should be deleted to appear as per attached Title page.

Signed and Sealed this

Twenty-sixth Day of April, 1994

*Attest:*

Bruce Lehman

BRUCE LEHMAN

*Attesting Officer*

*Commissioner of Patents and Trademarks*

United States Patent [19]

Stepenoff

[11] Patent Number: 5,284,250

[45] Date of Patent: Feb. 8, 1994

[54] PARTICLE SEPARATION APPARATUS

[76] Inventor: Gary F. Stepenoff, 8732 E. Piccadilly, Scottsdale, Ariz. 85251

[21] Appl. No.: 759,213

[22] Filed: Sep. 13, 1991

[51] Int. Cl.[5] ..... B03B 5/00

[52] U.S. Cl. ..... 209/211; 210/512.1

[58] Field of Search ..... 209/208, 210, 211; 210/787, 512.1, 374

[56] References Cited

U.S. PATENT DOCUMENTS

| | | | |
|---|---|---|---|
| 3,235,091 | 2/1966 | Doll et al. | 209/210 X |
| 4,120,783 | 10/1978 | Baummer | 209/210 |
| 4,759,854 | 7/1988 | Wilson | 209/211 X |
| 4,863,605 | 9/1989 | Rienecker | 209/211 X |
| 5,104,520 | 4/1992 | Maronde et al. | 209/211 X |
| 5,114,568 | 5/1992 | Brinsmead et al. | 209/211 X |

FOREIGN PATENT DOCUMENTS

| | | | |
|---|---|---|---|
| 30003 | 7/1954 | Switzerland | 209/211 |

*Primary Examiner*—Donald T. Hajec
*Attorney, Agent, or Firm*—Tod R. Nissle

[57] ABSTRACT

Apparatus which separates particles by size or by specific gravity. The apparatus separates particles from a liquid slurry by directing the slurry into a particle separation chamber which circulates slurry particles along helical paths in the chamber. The apparatus continues to circulate slurry particles along helical paths of travel after the flow of liquid slurry into the particle separation chamber is discontinued.

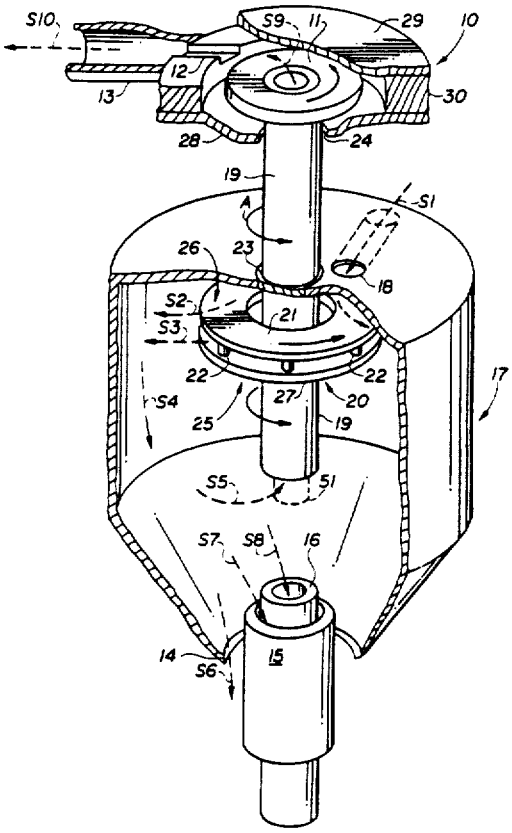

6 Claims, 2 Drawing Sheets